US005707036A

United States Patent [19]

Dunbar

[11] Patent Number: 5,707,036

[45] Date of Patent: Jan. 13, 1998

[54] BATHTUB BOOK HOLDING DEVICE

[76] Inventor: Ronald Dunbar, 15484 Hamlin Ave., Markham, Ill. 60426

[21] Appl. No.: 661,354

[22] Filed: Jun. 11, 1996

[51] Int. Cl.[6] ..... A47B 97/04

[52] U.S. Cl. ..... 248/447.2; 248/229.22

[58] Field of Search ..... 248/444, 444.1, 248/447, 447.2, 451, 452, 458, 230.2, 231.31, 292.12, 229.2, 229.22; 403/400

[56] References Cited

U.S. PATENT DOCUMENTS

| | | | |
|---|---|---|---|
| 714,101 | 11/1902 | David | 403/400 |
| 2,535,112 | 12/1950 | Woody | 248/230.4 |
| 2,622,831 | 12/1952 | Fullwood | 248/292.12 |
| 2,896,895 | 7/1959 | Speese | 4/559 |
| 3,408,032 | 10/1968 | Francis | 248/447.2 |
| 3,950,793 | 4/1976 | Adams | 248/444.1 |
| 4,256,281 | 3/1981 | Harris et al. | 248/231 |
| 4,754,945 | 7/1988 | Diamond | 248/460 |
| 5,154,391 | 10/1992 | Hegarty | 248/454 |
| 5,621,927 | 4/1997 | Reiss et al. | 4/559 |

*Primary Examiner*—Ramon O. Ramirez
*Attorney, Agent, or Firm*—Barbara R. Greenberg

[57] ABSTRACT

A bathtub book holding device that includes a bathtub rim clamping member with adjustable grasping legs and a top platform circular post to telescopically receive a T-shaped tubular connector which also receives telescopically a supporting beam member affixed to a rectangular planar book supporting member; the T-shaped connector replaceable with offset adjustable and non adjustable cross fittings to enhance vertical, horizontal and angular rectangular planar book supporting member ideal placement.

6 Claims, 3 Drawing Sheets

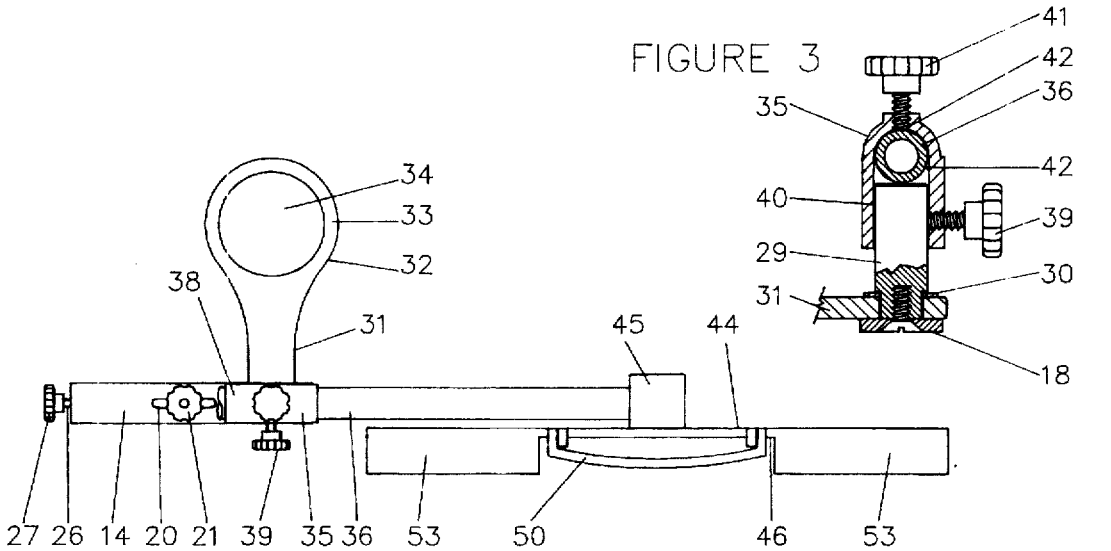
FIGURE 2
FIGURE 3
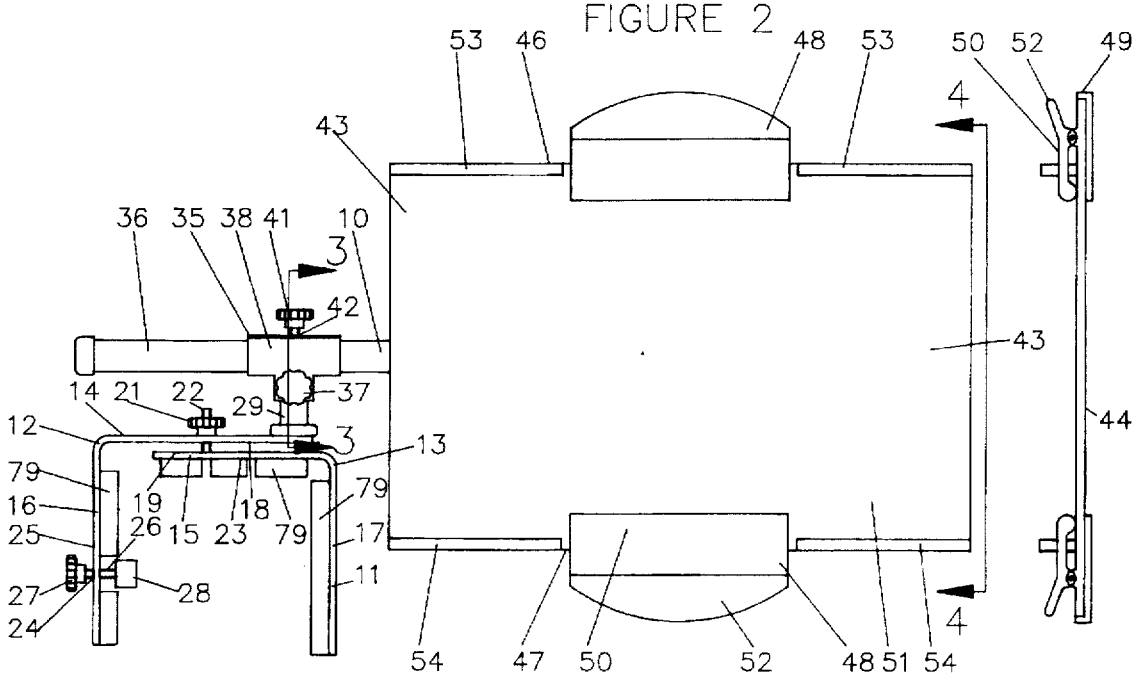
FIGURE 1
FIGURE 4

FIGURE 7
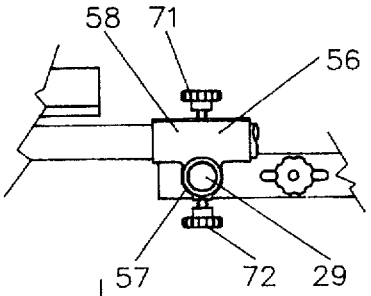
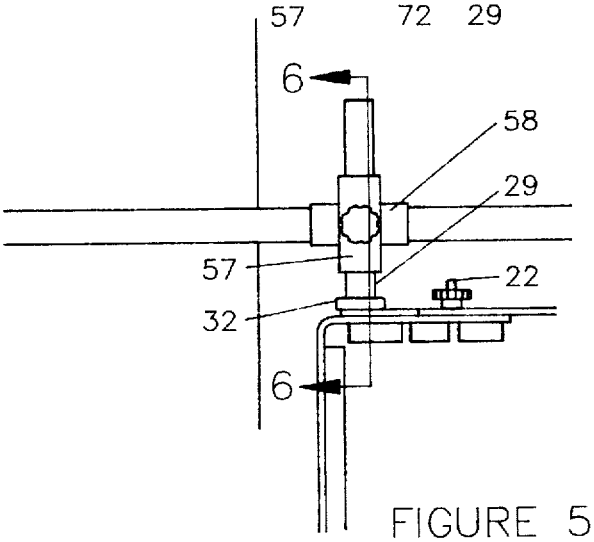
FIGURE 5
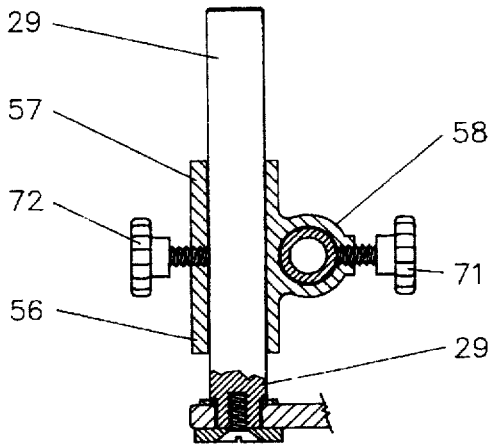
FIGURE 6

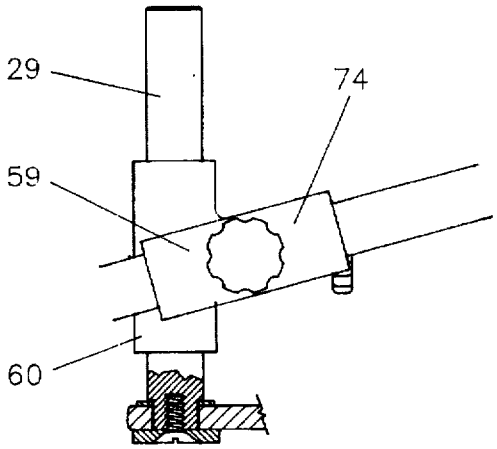
FIGURE 12
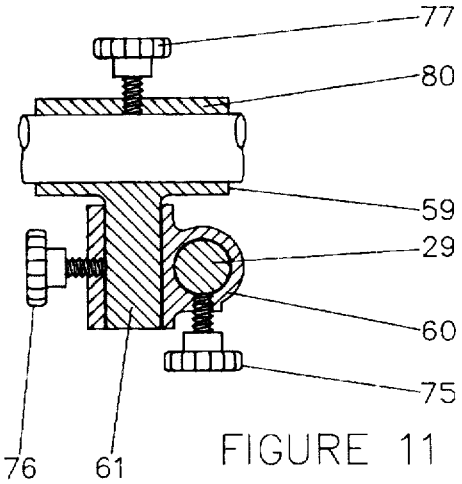
FIGURE 11
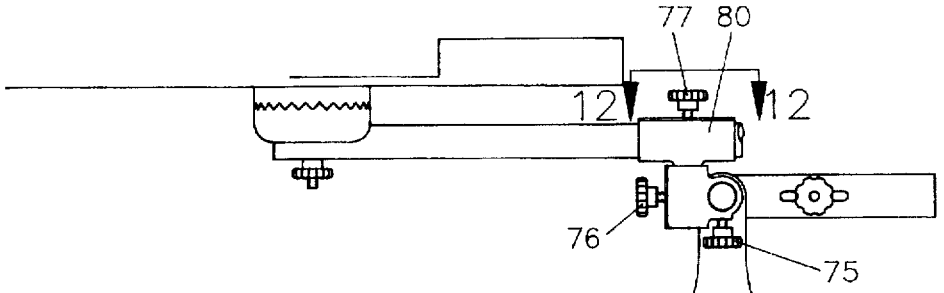
FIGURE 10
FIGURE 9
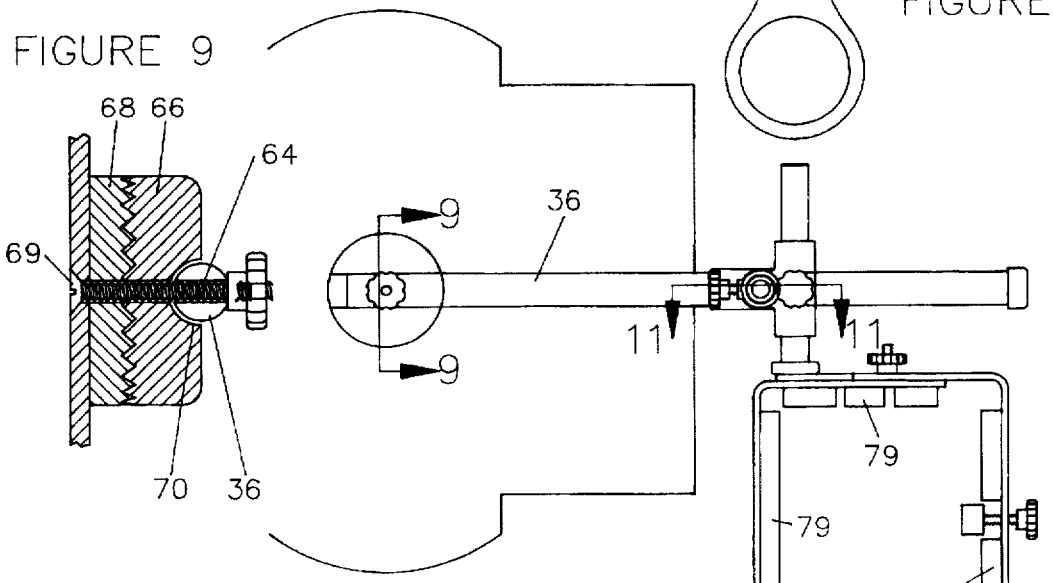
FIGURE 8

BATHTUB BOOK HOLDING DEVICE

BACKGROUND OF THE INVENTION a) Field of the Invention

This invention relates to devices designed to support and position precisely books, magazines, and the like, which can be used by a person, sitting in a water filled bathtub or whirlpool bath, to read, without holding it, a book or magazine, and, more particularly, a bathtub book holding device that, after use, can easily be manually rotated to a position parallel to the bathtub side rim without removal of the book or magazine in order to permit the person easy exit from the bathtub.

b) Description of the Prior Art

Various bathtub book holding devices that support and position an associated book support member to permit a bathtub user hand free book holding are disclosed in prior art writings. U.S. Pat. No. 2,006,169 to Harris-Jones sets forth a bookrest for bathtubs that provides for a supporting tray to hold books and mirrors and is foldable into a compact form after use. This tray bookrest has no tilting capability for any book or mirror positioning. Also, it cannot be adjusted vertically, so it appears that it can be flooded with water by a restless bather or vigorous whirlpool action. Also, it must be lifted and entirely removed from a bathtub in order for a bather to leave the bathtub. U.S. Pat. No. 3,950,793 to Adams sets forth a bathtub book stand that provides for a horizontal book support beam extending across a bathtub from one bathtub side rim to the other. In this arrangement, a book supporting member can be tilted at varying angles but, once again, there is no vertical adjustment capability and, also, the entire book stand must be lifted from the bathtub before a user can exit.

There still remains a need for a bathtub book holding device that is secured to a bathtub rim, that can be positioned for convenient use and then pushed aside for easy bathtub exit, that can be adjusted to prevent water damage to books and magazines and, also, that can remain attached to the bathtub rim after a person leaves. Such a bathtub book holding device would have special value to an individual who is disabled, needs water therapy and cannot manipulate and remove a cumbersome, heavy bathtub book holder.

SUMMARY OF THE INVENTION

In light of the foregoing disadvantages existing in the types of bathtub book holders now present in the prior art, the present bathtub book holding device has a planar rectangular book holding structure affixed to a support beam vertically, horizontally and rotationally adjustable, telescopically mounted on a circular post secured to a bathtub rim clamping member adjustably mounted on the bathtub rim. In addition, a paddle shaped bottle or cup holding member is initially received by the circular post for the user's convenience while bathing. Also, the bathtub rim clamping member has inner surface resilient padding grooved to receive bathtub rim installed shower door tracks. The support beam adjustment capabilities allow positioning of the planar book holding structure to prevent book water damage and permit support beam rotation to the bathtub rim so that the user can stand up and leave the bathtub without book holding device removal. The book holding device can be permanently left on the bathtub rim or removed when it is necessary to slide a shower door across tracks or for tub cleaning.

The general purpose of this invention is to provide a new and improved bathtub book holding device which has more advantages than prior art bathtub book holders and none of their disadvantages. A more specific objective of the present invention is to provide a bathtub book holding device that can be permanently affixed to a tub or, if desired, easily removed, with means for effortlessly rotating vertically and along a horizontal axis a support beam for a planar book holding structure which can be positioned in front of the user or pushed to a position parallel to a bathtub rim so that no barrier blocks bathtub exit.

Another objective of the invention is to provide a bathtub book holding device that has adjustable means for secure placement over shower door tracks on bathtub rims.

An even further object of the invention is to provide a bathtub book holding device that can accommodate a bather facing bathtub faucets or with the bather's back to the faucets by a simple horizontal and vertical rotation of the book holder support beam.

Still another object of the invention is to provide a bathtub book holding device which is durable and simple to adjust for the pleasure of all users, and particularly, to enable a person who is disabled and in need of water therapy to enjoy armless book holding and easy bathtub exiting.

BRIEF DESCRIPTION OF THE DRAWINGS

Objectives and advantages of the invention in addition to those set forth above will become apparent when the invention is described hereinafter in greater detail with reference to the accompanying drawings, wherein:

FIG. 1 is a front plan view of the bathtub book holding device of this invention;

FIG. 2 is a top view of the bathtub book holding device fitted with a T-shaped cross connector and a cup or bottle holder member;

FIG. 3 is a section through 3—3 of FIG. 1;

FIG. 4 is a side view of the rectangular planar book supporting member;

FIG. 5 is a back plan view of the bathtub book holding device fitted with an offset cross connector;

FIG. 6 is a section through 6—6 of FIG. 5;

FIG. 7 is a top view of the bathtub book holding device offset cross connector;

FIG. 8 is a back plan view of the bathtub book holding device fitted with an adjustable offset cross connector.

FIG. 9 is a section through 9–9 of FIG. 8;

FIG. 10 is a top view of the bathtub book holding device with the adjustable offset cross connector and the cup or bottle holder;

FIG. 11 is a section through 11—11 of FIG. 8; and

FIG. 12 is a section through 12—12 of FIG. 10.

DETAILED DESCRIPTION OF THE INVENTION

Referring now to the drawings, and, more particularly, to FIG. 1, a bathtub book holding device, which is indicated generally by reference numeral 10 essentially comprises A bathtub rim clamping member 11 composed of two inverted L-shaped components 12, 13 having horizontal platform portions 14, 15, respectively, and leg portions 16, 17, respectively, where a bottom surface 18 of one inverted L-shaped component 12 upper horizontal platform 14 is overlapping and adjacent to a top surface 19 of the other inverted L-shaped component 13 lower horizontal platform 15.

For the purpose of adjusting the distance between the inverted L-shaped components 12, 13 leg portions 16, 17, in order to fit the book holding device 10 snugly on a bathtub rim, the horizontal platform 14 has a centrally disposed longitudinal slot aperture 20 as seen in FIG. 2, having a length, preferably, of at least one eighth the length of the inverted L-shaped component 12 horizontal platform 14 and having a width necessary to receive a threaded shank of bolt 22 which is affixed to a bottom surface 23 of the inverted L-shaped component 13 horizontal platform 15 so that the threaded shank of bolt 22 is passed upwardly through the longitudinal slot aperture 20 and slid horizontally until the leg portions 16, 17 grasp both sides of a bathtub rim. Then a threaded clamping knob 21 is rotated around the threaded shank of bolt 22 to immobilize and secure inverted L-shaped components 12, 13 in a bathtub grasping position. A wing tip threaded nut can be used in place of threaded knob 21 and bolt 22.

As shown in FIG. 1, for additional support, aperture 24 with threaded walls, located centrally within the top surface 25 of leg portion 16, receives a threaded bolt 26 having a distal knob handle 27 and a proximal end affixed to resilient material 28 so that rotating the knob handle 27 can move the resilient material 28 against a bathtub wall outer or inner surface and further secure the clamping member 11 to a bathtub rim. The resilient material 28 can be in the form of a suction cup for greater adhesion to the bathtub wall outer surface. The resilient material 28 can be rubber, a polypropylene plastic, a sponge like material or virtually any substance that rebounds after use to its original shape and is a solid at room temperature.

Secured by screw means to an end portion of the horizontal platform 14 of the inverted L-shaped component 12 is a circular post 29, preferably about one inch in height, disposed to receive a proximal neck end 31 of a paddle shaped cup or bottle holder 32 having a distal head end 33 with a depressed top surface 34 designed to hold cups or bottles as is illustrated in FIG. 2. A spring washer 30 placed between the cup or bottle holder 32 proximal neck end 31 and the circular post 29 allows the cup or bottle holder 32 to rotate horizontally for the convenience of the user.

Referring to FIG. 3, a T-shaped tubular fitting member 35 provides connecting means from the circular post 29 to a supporting beam 36 having a plurality of lengths but, preferably, 18.0 inches (45.7 cm), two thirds the width of a conventional bathtub inner walls. The T-shaped tubular fitting member 35 is of an internal diameter slightly larger than the circular post 29 diameter and the support beam 36 diameter. This allows a stem portion 37 of the T-shaped tubular fitting 35 to connect telescopically to the circular post 29 and rotate horizontally 360° around the circular post 29. Next, the supporting beam 36 proximal end is slipped through a horizontal portion 38 of the T-shaped tubular fitting member 35 preferably to a distance one inch beyond the horizontal arm portion 38, or at a distance greater depending on a bathtub width, where the supporting beam 36 can be horizontally adjusted and also rotate 360° within the T-shaped tubular fitting 33.

The supporting beam 36 can be raised or lowered vertically by raising or lowering the T-shaped tubular fitting member 35 stem portion 37 and tightening against the circular post 29 a flat end thumb screw 39 disposed through an aperture 40 located centrally in relation to the T-shaped tubular fitting 35 horizontal portion 38. Then, the supporting beam 36 is adjusted horizontally and then secured to the T-shaped tubular fitting member 33 by a flat end thumb screw 41 disposed through an aperture 42 located centrally in the horizontal portion 38 of the T-shaped tubular fitting 35. The user slides the supporting beam 36 horizontally to a desired book holding distance and then tightens the flat end thumb screw 41 against the supporting beam 36. These vertical and horizontal adjustments are easily made by a bathtub user sitting in a bathtub.

As shown in FIGS. 1, 4 and 8, a rectangular planar book supporting member 43 is affixed to the supporting beam 36 distal end permanently secured by bolt mean to a back surface 44 block structure 45 of the rectangular planar book supporting member 43. On a top edge 46 and a bottom edge 47 of the rectangular planar book supporting member 43, there are centrally mounted clamping means 48 having one base blade 49 bolted to the rectangular planar book supporting member 43 back surface 44 and the opposing base blade 50 urged by spring action to a closed position with respect to the rectangular planar book supporting member 43 front surface 51 and which can be urged to an open position by pressure on clamping means 48 handle ends 52 resulting in spring torsion increase. At this point, books, magazines, a mirror or other flat objects can be inserted in the openings provided after which the handle end 52 pressure is released eliminating spring torsion and the base blade 50 springs back to clamp the inserted object. Such clamping means, as described herein, are commonly used to clamp papers to a flat surface or to clamp bags, or the like, to a closed position.

In order for the user to easily adjust the bathtub book holding device 10 when facing a bathtub's faucet end or when facing the opposite end, the rectangular planar book supporting member 43 has a top ledge 53 and a bottom ledge 54 as seen in FIGS. 1 and 2. As the user rotates the supporting beam 36 horizontally within the T-shaped tubular fitting member 35, the rectangular planar book supporting member will rotate also, and the top ledge 53 and bottom ledge 54 will reverse positions. In addition, upon rotation of the supporting beam 36, the back surface 44 and front surface 51 will also reverse to face opposite ends of the bathtub.

In another embodiment, as illustrated in FIGS. 5, 6 and 7, the T-shaped tubular fitting member 35 is replaced by an offset cross fitting member 56 in order to increase the vertical adjustment capability for the supporting beam 36. A vertical fitting portion 57 of the offset cross fitting 56 is telescopically received by circular post 29, elongated, preferably, to height of at least three inches, so when the vertical fitting portion 57 is slidingly moved up and down, the supporting beam 36, which is telescopically received by a horizontal fitting portion 58 of the offset cross fitting 56, can be adjusted to an ideal height above a bathtub water surface. Then, supporting beam 36 is anchored to the horizontal fitting portion 58 by screw means 71 and the vertical fitting portion 57 is anchored to the elongated circular post 29 by screw means 72.

As is shown in FIGS. 8, 10, 11 and 12, in a third embodiment of the bathtub book holding device 10, the T-shaped tubular fitting member 35 is replace by an adjustable offset cross fitting member 59 having a first tubular fitting 60 with a right angle side arm 61, the tubular fitting 60 vertical portion received by circular post 29 and the side arm 61 telescopically and rotatably inserted into the lower horizontal portion of a second cross shaped tubular fitting 74 whose upper horizontal portion telescopically receives supporting beam 36. Angular adjustment of the supporting beam 36 through a plurality of angles relative to a bathtub water surface is made by manual rotation of supporting beam 36 where the second tubular fitting 74 lower horizontal portion pivots around the first tubular fitting 60 right angle arm 61. The tubular fitting 60 vertical portion is adjustably secured to circular post 29 by screw means 75, the right angle side arm 61 is adjustably secured to the lower horizontal portion of the cross shaped second fitting 74 by screw means 76 and the upper horizontal portion 80 of the cross shaped tubular fitting 74 is adjustably secured to the supporting beam 36 by screw means 77. As the supporting beam 36 is moved away from the bathtub water surface at preferred angles ranging from 0° to 45°, the rectangular planar book support member 43 can be manually rotated to a horizontal position using an adjustable interlocking disk means 62 in order to remain parallel to the water surface. The interlocking disk means 62 is centrally affixed to the rectangular planar book support member 43 back surface 44 by a clamping knob 63 fitted with a threaded stud insert 64 whose distal portion 65 is plain and projected firmly but rotationally through the supporting beam 36 distal end and firmly but rotatably through a top interlocking grooved disk 66 and whose proximal portion 67 is threaded and enters by screw means a bottom interlocking grooved disk 68 affixed to the back surface 44 and finally enters a back surface 44 threaded aperture 69. The supporting beam 36 rests in a depression 70 located on a top surface 78 of top interlocking grooved disk 66. When the rectangular planar book support member 43 is adjusted to a position parallel to the water and moved to a comfortable distance above the water surface, the user can rotatably tighten the clamping knob 63 to interlock the top interlocking grooved disk 66 with the bottom interlocking grooved disk 68 so that the rectangular planar book support member 43 is parallel to the water surface and rigid to receive a book, magazine, or the like.

In another embodiment of the bathtub book holding device, circular post 29 is secured by screw means to a rectangular plate which can be affixed by adhesive materials, Velcro or other securing means, to a narrow tub rim eliminating the need for the bathtub rim clamping member 11 and allowing the use of the bathtub book holding device 10 in a large variety of bathtub rim configurations. All of the abovementioned connecting means can be used in this rectangular plate affixed bathtub book holding device 10.

The bathtub book holding device 10 can be made of stainless steel or, to reduce weight and retain rust proof properties, anodized aluminum or a plastic material such as nylon. A combination of these materials, each selected as suited to a different component can also be used. To prevent marring of a bathtub finish, the bathtub clamping member 11 inner surfaces are fitted with resilient material padding strips 79 that adhere to the inner surfaces by reattachable type adhesives or by Velcro type attachment. On the bottom surface 23 of the inverted L-shaped component 13 horizontal platform 15, padding strips 79, preferably one inch in width, are adjustably secured where the user can rearrange the padding strips 69 so that spaces are formed to accommodate bathtub rim projections such as shower door tracks.

With regard to the above description, many possible variations and modification of this invention are suggested that fall within the scope and spirit of the invention. Further, since numerous modification and changes will most likely occur to those skilled in the art, it is not desired to limit the invention to the details of structure specifically described or illustrated. Accordingly, within the scope of the appended claims, the invention may be practiced otherwise than as specifically described or illustrated.

I claim:

1. A bathtub book holding device comprising:

a bathtub rim clamping member having a lower inverted L-shaped component with a platform portion and an upper inverted L-shaped component with a platform portion arranged so that said platform portions overlap to result in upper and lower adjacent platforms, and are affixed by a threaded bolt shank that extends upwards from said lower inverted L-shaped component platform through a centrally disposed longitudinal slot in said upper L-shaped component platform where a threaded clamping knob is rotated around said threaded bolt shank to immobilize and secure said L-shaped components in a bathtub rim grasping position; and said upper L-shaped component platform end portion having a circular post that receives a paddle shaped cup holder and a leg portion of said inverted L-shaped component having a centrally located threaded aperture to receive a threaded bolt with a distal knob end and proximal end affixed with resilient material so that rotating said knob handle will move said resilient material against a bathtub wall and further immobilize and secure said clamping member to a bathtub rim;

a T-shaped tubular fitting member providing telescopic connecting means to said L-shaped component platform end portion circular post and to a supporting bean, said T-shaped tubular fitting having a stem portion aperture to receive a flat end thumb screw that is turned to secure said T-shaped tubular fitting to said circular post and having a horizontal portion aperture to receive a flat end thumb screw that is turned to secure said T-shaped tubular fitting to said supporting beam; and a rectangular planar book supporting member secured to said supporting beam by bolt means and having top and bottom mounted clamping means and top and bottom book supporting ledges.

2. The bathtub book holding device of claim 1, wherein said supporting beam and said circular post are telescopically received, respectively, by an offset cross fitting member horizontal portion and an offset cross fitting member vertical portion where said horizontal portion is secured to said supporting beam by screw means and where said vertical portion is slidingly adjustable to an ideal height and then secured by screw means to said circular post being at least three inches in height.

3. The bathtub book holding device of claim 1, wherein said circular post is secured by screw means to a rectangular plate which is anchored to a bathtub rim by adhesive means.

4. The bathtub book holding device of claim 1, wherein said rectangular planar book support member supporting beam connector means has top and bottom interlocking grooved disks connected to said supporting beam distal end by a clamping knob fitted with a stud insert having a plain distal portion and a threaded proximal portion for rotatably tightening said clamping knob to interlock said top and bottom disks and affix said supporting beam and said interlocking grooved disks to said rectangular planar book support back surface, said top interlocking grooved disk having a half circle depression to contain said supporting beam.

5. The bathtub book holding device of claim 1, wherein said bathtub rim clamping member is fitted with inner surface padding strips that adhere to the bathtub rim clamping member inner surface by a reattachable adhesive for instant adjustment of said padding strips to accommodate bathtub rim projections by providing adequate receiving spaces.

6. A bathtub book holding device comprising:

a bathtub rim clamping member having a lower inverted L shaped component with a platform portion and an upper inverted L-shaped component with a platform portion arranged so that said platform portions overlap to result in upper and lower adjacent platforms, and are affixed by a threaded bolt shank that extends upwards from said lower inverted L-shaped component platform through a centrally disposed longitudinal slot in said upper L-shaped component platform where a threaded clamping knob is rotated around said threaded bolt shank to immobilize and secure said L-shaped components in a bathtub rim grasping position; and said upper L-shaped component platform end portion having a circular post that receives a paddle shaped cup holder and a leg portion of said inverted L-shaped component having a centrally located threaded aperture to receive a threaded bolt with a distal knob end and proximal end affixed with resilient material so that rotating said knob handle will move said resilient material against a bathtub wall and further immobilize and secure said clamping member to a bathtub rim;

an adjustable offset cross fitting member having a first tubular fitting with a right side arm, the first tubular fitting received by said circular post and the right side arm rotatably inserted into a lower horizontal portion of a second cross shaped tubular fitting whose upper horizontal portion telescopically receives a supporting beam; and a rectangular planar book supporting member secured to said supporting beam by bolt means and having top and bottom mounted clamping means and top and bottom book supporting ledges.

* * * * *